US007250004B2

(12) United States Patent
Mollin et al.

(10) Patent No.: US 7,250,004 B2
(45) Date of Patent: Jul. 31, 2007

(54) SKIING RUN WITH MEANS FOR PRESERVING SNOW

(76) Inventors: Henri Mollin, De Dreef van Hertebos 40, B-2970 Schilde (BE); Raimund Crammer, Südtirolergasse 17, A-2340 Mödling (AT)

( * ) Notice: Subject to any disclaimer, the term of this patent is extended or adjusted under 35 U.S.C. 154(b) by 0 days.

(21) Appl. No.: 11/099,825

(22) Filed: Apr. 6, 2005

(65) Prior Publication Data

US 2005/0239564 A1 Oct. 27, 2005

Related U.S. Application Data

(63) Continuation-in-part of application No. PCT/BE03/00169, filed on Oct. 9, 2003.

(51) Int. Cl.
*A63C 19/10* (2006.01)

(52) U.S. Cl. ..... 472/90; 62/70

(58) Field of Classification Search ..... 472/88–90; 62/66, 69, 70

See application file for complete search history.

(56) References Cited

U.S. PATENT DOCUMENTS 2,878,651 A * 3/1959 Heinzelman ..... 62/235
3,443,492 A * 5/1969 Pleass ..... 472/90
3,815,901 A * 6/1974 Wiig ..... 472/90
3,893,507 A 7/1975 MacCracken et al. ..... 165/46
4,742,958 A 5/1988 Bucceri ..... 239/2.2
5,230,218 A * 7/1993 Clulow ..... 62/74
6,006,826 A 12/1999 Goddard et al. ..... 165/179
6,176,091 B1 1/2001 Kishi et al. ..... 62/70
6,418,733 B1 7/2002 Morent ..... 62/66

OTHER PUBLICATIONS

International Search Report for PCT/BE03/00169 Dated Jan. 15, 2004.

* cited by examiner

*Primary Examiner*—Kien Nguyen
(74) *Attorney, Agent, or Firm*—Ostrolenk, Faber, Gerb & Soffen, LLP

(57) ABSTRACT

Ski run provided with a means for preserving snow on the skiing surface, said means comprising at least pipes suitable for the flow of a cooling agent for cooling the snow present on the skiing surface, said pipes (1) being embedded and located in a layer (5) enabling, when the layer (5) has a temperature of at least 2° C., a water percolation through the layer (5). Below the layer (5), a draining system (6,7) is placed for collecting and draining at least substantially all the water percolating through the layer (5) in which the pipes (1) are embedded.

32 Claims, 1 Drawing Sheet

SKIING RUN WITH MEANS FOR PRESERVING SNOW

This application is a continuation in part of PCT/BE03/00169 filed on Oct. 9, 2003 and published on Apr. 22, 2004 under number WO2004/033973, claiming the priority of European patent application EP 02 447 194.8 filed on Oct. 10, 2002

FIELD OF THE INVENTION

The present invention relates to a ski run, especially a ski slope provided with for preserving snow.

THE PRIOR ART

System for preserving snow have already been proposed in the past. For example, U.S. Pat. No. 6,418,733 discloses a mat with a piping system intended to be placed directly on an existing snow layer. After the season, the mats have to be removed. Problems with such mats are:

- possible damages by skiers or machine traveling on the ski runs, the mats are only protected by a ice layer and snow,
- extensive works required for the placement of the mats when there is already snow on the ski run, as well for removing the mats at the end of the season;
- as many mats have to be used and to be connected to a cooling station, the risk of leaks are huge, whereby it is proposed to use colored cooling agent.
- When a heavy rain falls on a slope covered with such mats, a high risk exists that all the mats fall, as the mat are placed on an existing snow layer.
- The use of mats destroys the vegetation existing on the slope, whereby grounds and stones of the slope are more easily taken away during a heavy rain.

U.S. Pat. No. 3,893,507 discloses an apparatus for creating an ice slab for skating or for maintaining a layer of snow for skiing. The apparatus consists of a series of adjacent flexible tubes connected to a supply pipe for fresh cooling medium and to a collecting pipe for collecting cooling medium after its passage in the medium. In the embodiment of FIG. 16 used for an ice rink, the tubes are embedded in a horizontal sand layer placed over an insulation layer. Such an embodiment is not suitable for being used on a ski slope, as soon as the ice layer is removed, an aqueous sand mixture will be formed, whereby in case the system would be used on a slope, the sand will falls in the valley and will cause damages to the flexible tubes. In case such a tubing system would have been used for preserving snow on a slope of a ski run, it would have been necessary to place the system before the ski season and to remove it at the end of the ski season, whereby requiring extensive works, and whereby having huge risk of possible damages for the tubes and huge risk of possible leaks.

U.S. Pat. No. 3,893,507 refers also to prior system for ice rink, in which metal pipe are embedded in concrete (FIG. 18 of U.S. Pat. No. 3,893,507). The use of concrete is not ecological and is not appropriate for the preparation of skiing surface, especially with slope. Further the adherence of snow on a concrete layer is often not adequate, especially in case of rain.

U.S. Pat. No. 4,742,958 discloses a method of making artificial snow, and to a skiing slope using such an artificial snow. In said document, reference is made to the laying of said artificial snow on a refrigerated floor consisting of flexible refrigeration pipe laid in a sand bed on a subsoil base. Such a skiing slope is an indoor skiing slope as the artificial snow comprises polymer, and as the subsoil has to be impermeable so as to enable to collect water from melting snow in the side drains.

U.S. Pat. No. 6,176,091 discloses a method for preventing snow from melting, in which dry air is injected so as to permeate through the snow layer. For enabling said injection, the pipes are located in the snow layer, i.e. above an impermeable platform provided with drainage gutter. Such a method is not suitable for outside operation, as after the winter period, it is necessary to remove all the piping. U.S. Pat. No. 6,006,826 discloses an ice ring installation, which is not suitable for outside use for preserving snow for having a longer winter skiing period.

The present invention relates a ski run (such as an outdoor ski run, especially a substantially natural ski run), which is ecological and which does not require extensive works at the begin of the winter skiing season and at the end of the winter skiing season.

BRIEF DESCRIPTION OF THE INVENTION

The invention relates to a ski run provided with a means for preserving snow on the skiing surface, said means comprising at least a piping circuit suitable for the flow of a cooling agent for cooling the snow present on the skiing surface. Said ski run is characterized in that the piping circuit comprises several pipes embedded and located in a layer enabling, when the layer has a temperature of at least 2° C., a water percolation through the layer, and in that below the layer in which the pipes are embedded, a draining system is placed for collecting and draining at least substantially all the water percolating through the layer in which the pipes are embedded.

According to an embodiment, the pipes are embedded and located in a layer enabling a water percolation of at least 0.5 liter/$m^2$/day, advantageously of at least 1 liter/$m^2$/day, preferably at least 2 liter/$m^2$/day, for example a water percolation comprised between 5 and 100 liters/$m^2$/day, or even more.

According to an advantageous detail, the layer in which the pipes are embedded is a layer enabling the growth of plants or vegetation when the snow is no more present above said layer. For example, the layer is covered at least partly with vegetation or plants having roots extending at least partly in the layer, advantageously at least partly up to the neighborhood of the cooling pipes. The presence of vegetation seems to be advantageous for keeping the structure of the layer or ground layer in which the pipes are embedded, for forming a layer resisting to erosion, and for attaching the snow layer on the upper face of the layer or ground layer.

For example, at least part of the vegetation or plants growing in said layer has a height of at least 5 cm before being possibly compressed by snow. The vegetation present on a slope provided with the system of the invention can be cut at the desired height or can be eaten by cows or other animals before starting the ski season, preferably the winter ski season.

For example, the upper face of the layer in which the pipes are embedded has an upper face and a lower face, the pipes extending at least 0.5 cm below the upper face, advantageously at least 3 cm below the upper face, preferably at least 5 cm below the upper face. The pipes will most preferably be embedded at least 10 cm below the upper face, so as to provide sufficient protection due to the passage of possible machines or animals (cows, lambs, etc.)

According to an embodiment, the pipes are embedded in a layer having a thickness comprised between 5 cm and 100 cm, advantageously comprised between 7 cm and 50 cm, most preferably between 10 cm and 30 cm. The pipes are for example pipes with a circular cross section, for example with an inner diameter comprised between 1 cm and 10 cm, or even more, but said diameter being preferably lower than about 6 cm, such as 2 cm, 3 cm, 4 cm and 5 cm. Other cross sections are possible for the pipes.

According to an advantageous embodiment, the pipes are embedded and located in the layer, so that a least part of the draining system remains at a temperature higher than 0° C.

For example, the draining system comprises a porous layer with a thickness greater than 5 cm, advantageously comprised between 7 and 30 cm, said porous layer comprising a large proportion of particles with a size greater than 0.5 cm. The thickness of the draining layer can vary, for example in case of a slope. For example said porous layer comprises at least 10% by volume, such as from 15 to 60% by volume of solid particles with a size greater than 0.5 cm, such as from 1 to 10 cm, such as from 1 to 5 cm or from 2 to 4 cm.

The pipes embedded in the layer can be used for removing the snow by heating. In such a case, a hot or warmed medium is flowing in the pipes, Possibly, specific pipes are embedded below the upper face of said layer for providing heat for removing the snow. Said specific pipes are for example located in the draining layer or below the draining layer.

For example, a heating system (for example with pipes) is placed under the draining system and/or in the draining system, so as reach a temperature of at least 0° C. in at least a portion of the draining system when water has to be drained, even if the layer in contact with ice and snow is still below 0° C.

The cooling pipes can be placed in any direction with respect to the common or normal skiing direction for ski run. However, for ski run having at least one slope, preferably a major portion of the pipes embedded in the layer follows at least partly the slope.

The cooling agent flowing in the pipes is advantageously liquid or a liquid able to be transformed into a gas at a temperature below 0° C. The flow of cooling agent is for example made under pressure, 1.1 bar (1.1 $10^5$ Pa) up to 10 bar (10 $10^5$ Pa) or even more. Possible cooling agents are urea or ammonia, alcohol, ethylene glycol, anti freeze liquid, anti freeze aqueous liquid, etc.

For the flowing of the coolant or cooling agent in the cooling pipes, one or more pumps can be used and/or in case of a ski run with a slope, the coolant can flow in the pipe by gravity.

The invention relates also to the use of a cooled ski run for preserving snow of a skiing surface of said ski run, whereby the ski run has a layered structure located below the skiing surface, said layered structure being provided with a cooling means for preserving snow of the skiing surface, said means for preserving snow comprising at least cooling pipes suitable for the flow of a cooling agent for cooling the snow present on the skiing surface, whereby the cooling pipes for the flow of a cooling agent are embedded and located in a first layer of the layered structure, said first layer being adapted for ensuring a water percolation through said first layer when said first layer has a temperature of at least 2° C., and whereby, below the first layer in which the cooling pipes are embedded, a draining porous layer extends for collecting and draining at least substantially all the water percolating through the first layer, whereby said draining porous layer has a thickness greater than 5 cm and comprises particles, a large proportion of said particles having a size greater than 0.5 cm, in which the cooling agent with a temperature lower than −5° C. (advantageously lower than −20° C., preferably lower than −50° C.) flows in cooling pipes embedded in the first layer.

Advantageously, the first layer of the ski run is adapted for ensuring a water percolation of at least 1 liter/$m^2$/day through said first layer, when said first layer has a temperature of at least 2° C.

Preferably, the first layer of the skin run is at least partly covered with vegetation or plants having roots extending at least partly in the first layer and/or roots extending in the layer at least partly up to the neighborhood of the cooling pipes. Most preferably, at least part of the vegetation or plants growing on said first layer of the ski run has a height of at least 5 cm before being possibly compressed by snow.

According to a preferred embodiment, the cooling carried out by the flow of cooling agent in the cooling pipes embedded and located in the first layer is such that at least part of the draining porous layer remains at a temperature higher than 0° C. when snow is present on the ski run.

A preferred example (given as example only) of embodiment of ski run of the invention will now be described. For said description, reference is made to the attached drawings.

BRIEF DESCRIPTION OF THE DRAWINGS

In said drawings.

DESCRIPTION OF A PREFERRED EMBODIMENT

Figure 1:
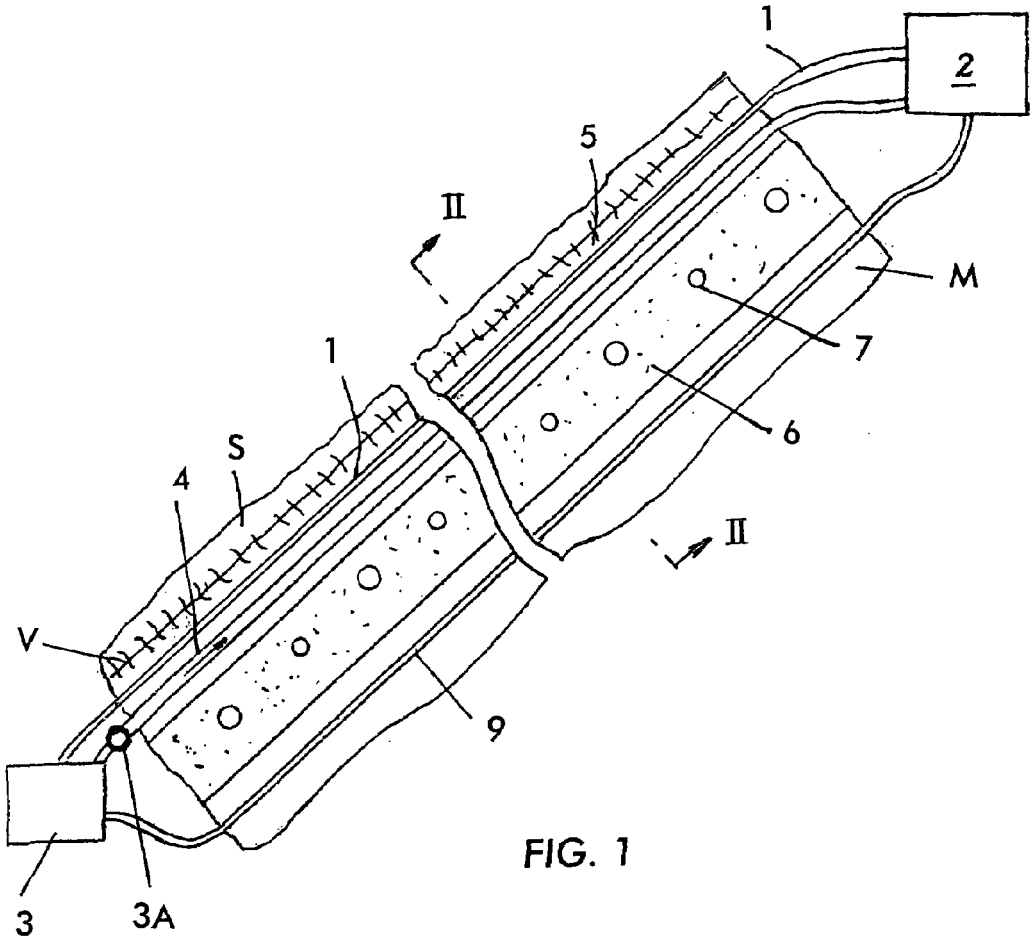
FIG. 1 is a schematic cross section view of a ski run with a slope.
Figure 2:
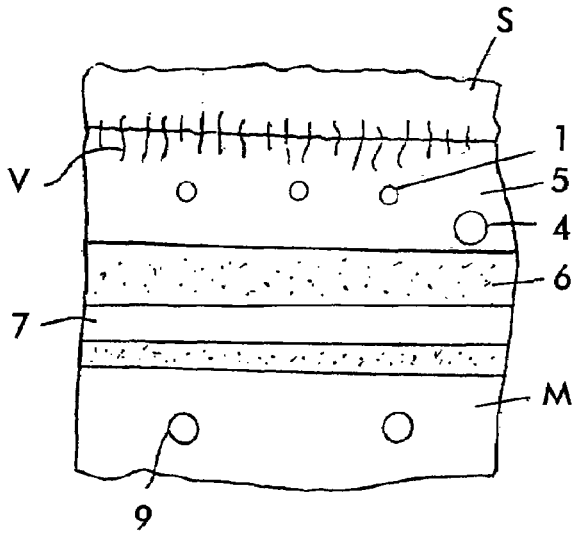
FIG. 2 is a cross section view along the line II—II of the ski run of FIG. 1.

FIG. 1 shows schematically a mountain M with a slope acting as ski run, when snow S is present on the slope. In order to preserve snow on said ski run, i.e. in order to have an extended skiing period or in order to preserve snow in an intermediate warmer period between two colder periods, the ski run is provided with means for cooling the snow and for preserving said snow.

The cooling means comprises a series of pipes 1 following the slope of the mountain M, said pipes 1 being connected to a cooling station 2 in which a coolant or cooling liquid is cooled at a temperature lower than −5° C., for example at a temperature lower than −20° C., such as temperature lower than −50° C. The coolant after its passage in the pipes 1 is collected in a collecting station 3, from which the coolant is pumped (pump 3A) for flowing the coolant back towards the cooling station 2 via the pipes 4.

The pipes 1 are embedded in a layer 5 enabling a water percolation in said layer, when said layer is no more frost. Said layer 5 is suitable for enabling the growth of vegetation or plants, such as the growth of grass. The layer 5 has a thickness of about 20 to 50 cm and the pipes 1 are located substantially in the middle of the layer 5. The distance between two adjacent pipes 1 can vary greatly and will be selected for ensuring a good cooling of the upper face of the layer 5 and thus of the snow. For example said distance can vary from 5 cm up to 100 cm, such as 10 cm, 15 cm, 20 cm, etc. The vegetation or grass V acts as means for increasing the structure properties of the layer 5 (due to the presence of roots), means for increasing the water percolation when the layer 5 is not frost, means for giving a natural aspect to the mountain during the summer, and as means for increasing the adherence of the snow or ice present on the slope.

Below the layer 5, a draining layer 6 is placed, said layer being suitable for collecting and draining the water percolating through the layer 5. Said layer 6 is for example made from stones, particles, granules, etc., especially natural stones with a large proportion of stones with a particle size larger than 5 mm. When required, additional draining pipes 7 can be placed in the layer 6, said pipes 6 extending for example substantially transversal with respect to the direction of the slope, so as to conduct excess water towards one or more edges of the mountain, or towards portions of the mountain not provided with the cooling means. The layer 6 has for example a variable thickness, thickness for example comprised between 5 and 20 cm. When the layer 6 has a constant thickness, said thickness is for example of about 10 cm.

The return pipes 4 are advantageously placed below the pipes 1, but above the draining layer 6. The return pipes 4 can have a large diameter than the pipe 1, for example a diameter of more than 5 or 10 times the diameter of the pipe 1, or even a more greater diameter. Pipes 9 can be used for providing some heat under the layer 6, for example for restoring quickly the growth of the vegetation and for having a quicker smelting of the snow. For the heating purpose, the cooling station and/or the collecting station can be provided with heating means, for example for heating a medium to a temperature of 20 to 40° C. and/or with pumping system.

For the return of the coolant, it is possible to use intermediate pumping station, if required.

Advantages of the ski run of the invention are:

when the snow is removed, the vegetation can grow as in normal way, whereby the mountain as a normal appearance;

no extensive works are required when the ski season starts or when the ski season ended;

the pipes are protected by a buffer zone or layer, whereby cows or lambs can eat the grass of the ski run without damaging the pipes;

better adherence of the snow due to the presence of vegetation;

possibility to heat the slope for activating the removal of the snow and the growth of the grass;

possibility to control the smelting of snow for some mountains, for example for delaying said smelting;

reduction of mud flow, longer skiing season;

the layer 5 and the vegetation act as a cold buffer volume or as a cold reservoir, whereby even if the cooling station has to repaired, the snow will not immediately smelt;

the cooling station can be placed in a building;

reduced leakage risks, as the pipes are not removed and unsealed from the cooling station at the end of the ski season;

etc.

What we claim is:

1. A ski run with a skiing surface provided with snow, said ski run having a layered structure located below the skiing surface, said layered structure being provided with a means for preserving snow of the skiing surface, said means for said system for preserving snow comprising:

at least cooling pipes suitable for the flow of a cooling agent for cooling the snow present on the skiing surface, whereby the cooling pipes for the flow of a cooling agent are embedded and located in a first layer of the layered structure, said first layer being adapted for ensuring a water percolation through said first layer when said first layer has a temperature of at least 2° C., and wherein below the first layer in which the cooling pipes are embedded, a draining porous layer extends, below the first layer, for collecting and draining at least substantially all the water percolating through the first layer, wherein said draining porous layer has a thickness greater than 5 cm and comprises particles, a large proportion of said particles having a size greater than 0.5 cm.

2. The ski run of claim 1, in which the first layer has a water percolation efficiency of at least 0.5 liter/$m^2$/day through said first layer, said water percolation efficiency being measured at a temperature of 2° C. for the first layer.

3. The ski run of claim 1, in which the first layer has a water percolation efficiency of at least 1 liter/$m^2$/day through said first layer, said water percolation efficiency being measured at a temperature of 2° C. for the first layer.

4. The ski run of claim 1, in which the first layer has a water percolation efficiency of at least 2 liter/$m^2$/day through said first layer, said water percolation efficiency being measured at a temperature of 2° C. for the first layer.

5. The ski run of claim 1, in which the first layer comprises material for enabling the growth of plants or vegetation when the snow absent above said first layer.

6. The ski run of claim 1, in which the first layer comprises material for increasing the adherence of the skiing surface provided with snow.

7. The ski run of claim 1, in which the first layer is at least partly covered with vegetation or plants having roots extending at least partly in the layer.

8. The ski run of claim 7, in which at least part of the vegetation or plants growing on said first layer has a height of at least 5 cm before being possibly compressed by snow.

9. The ski run of claim 1, in which the first layer is at least partly covered with vegetation or plants having roots extending in the layer at least partly up to the neighborhood of the cooling pipes.

10. The ski run of claim 9, in which at least part of the vegetation or plants growing on said first layer has a height of at least 5 cm before being possibly compressed by snow.

11. The ski run of claim 1, in which the first layer has an upper face and a lower face, whereby the pipes extend in the first layer at least 0.5 cm below the upper face.

12. The ski run of claim 1, in which the first layer has an upper face and a lower face, whereby the pipes extend in the first layer at least 3 cm below the upper face.

13. The ski run of claim 1, in which the first layer has an upper face and a lower face, whereby the pipes extend in the first layer at least 5 cm below the upper face.

14. The ski run of claim 1, in which the first layer has a thickness comprised between 5 cm and 100 cm.

15. The ski run of claim 1, in which the first layer has a thickness comprised between 7 cm and 50 cm.

16. The ski run of claim 1, in which the first layer has a thickness comprised between 10 cm and 30 cm.

17. The ski run of claim 1, in which the cooling pipes are embedded and located in the first layer, so that a least part of the draining porous layer remains at a temperature higher than 0° C. when snow is present on the ski run and when the cooling pipes are cooling the first layer.

18. The ski run of claim 1, in which the draining porous layer has a thickness comprised between 7 and 30 cm, said draining porous layer being made from solid particles, whereby a large proportion of solid particles have a size greater than 0.5 cm.

19. The ski run of claim 1, in which the cooling pipes embedded in the first layer are adapted, when required, for removing snow from the skiing run by flowing in said pipes a medium with a temperature higher than 10° C.

20. The ski run of claim 1, in which the first layer comprises a piping system for providing heat for removing snow from the skiing run.

21. The ski run of claim 1, in which a heating system is placed at least partly under the draining porous layer, said heating system being adapted for ensuring a temperature of at least 0° C. in at least a portion of the draining porous layer when water from the first layer has to be drained.

22. The ski run of claim 1, in which a heating system is placed at least partly in the draining porous layer, said heating system being adapted for ensuring a temperature of at least 0° C. in at least a portion of the draining porous layer when water from the first layer has to be drained.

23. The ski run of claim 1, said ski run having at least one slope, wherein a major portion of the cooling pipes embedded in the first layer follows at least partly the slope.

24. A method of cooling a ski run for preserving snow of a skiing surface of said ski run, comprising:

arranging a first layer in a layered structure located below the skiing surface for preserving snow of the skiing surface, said first layer comprising at least two cooling pipes suitable for the flow of a cooling agent for cooling the snow present on the skiing surface, the cooling pipes being embedded and located in said first layer of the layered structure, said first layer being adapted for ensuring a water percolation through said first layer when said first layer has a temperature of at least 2° C.; and providing, below the first layer, a draining porous layer disposed to collect and drain at least substantially all the water percolating through the first layer, wherein said draining porous layer has a thickness greater than 5 cm and comprises particles, a large proportion of said particles having a size greater than 0.5 cm; and providing the cooling agent with a temperature lower than −5° C. in the cooling pipes to cool the first layer for preserving snow of the skiing surface of the ski run.

25. The use method of claim 24, in which at least the first layer is cooled by the flowing of the cooling agent in the cooling pipes embedded in the first layer, said cooling agent having a temperature lower than −20° C.

26. The use method of claim 24, in which at least the first layer is cooled by the flowing of the cooling agent in the cooling pipes embedded in the first layer, said cooling agent having a temperature lower than −50° C.

27. The method of claim 24, in which the first layer has a water percolation efficiency of at least 1 liter/$m^2$/day through said first layer, said water percolation efficiency being measured at a temperature of 2° C. for the first layer.

28. The method of claim 24, in which the cooling agent having a temperature lower than −5° C. flowing in the cooling pipes of the first layer cools at least the first layer that is at least partly covered with vegetation or plants having roots extending at least partly in the first layer.

29. The method of claim 28, in which at least part of the vegetation or plants on said first layer of the ski run is grown to a height of at least 5 cm before being possibly compressed by snow.

30. The method of claim 24, in which the cooling agent having a temperature lower than −5° C. flowing in the cooling pipes of the first layer cools at least the first layer that is at least partly covered with vegetation or plants having roots extending in the first layer at least partly up to the neighborhood of the cooling pipes.

31. The method of claim 30, in which at least part of the vegetation or plants on said first layer of the ski run is grown to a height of at least 5 cm before being possibly compressed by snow.

32. The method of claim 24, in which the first layer is cooled by the flow of cooling agent in the cooling pipes embedded and located in the first layer is such that at least part of the draining porous layer remains at a temperature higher than 0° C. when snow is present on the ski run.

* * * * *